US009129564B2

(12) United States Patent
Liu

(10) Patent No.: US 9,129,564 B2
(45) Date of Patent: Sep. 8, 2015

(54) DISPLAY CONTROL METHOD USED IN DISPLAY APPARATUS WITH MULTIPLE COLOR LIGHT SOURCES

(71) Applicant: Hung-Ta Liu, Hsinchu (TW)

(72) Inventor: Hung-Ta Liu, Hsinchu (TW)

( * ) Notice: Subject to any disclaimer, the term of this patent is extended or adjusted under 35 U.S.C. 154(b) by 2 days.

(21) Appl. No.: 14/175,563

(22) Filed: Feb. 7, 2014

(65) Prior Publication Data

US 2014/0225934 A1 Aug. 14, 2014

(30) Foreign Application Priority Data

Feb. 8, 2013 (TW) ..... 102105277 A

(51) Int. Cl.
*G09G 5/10* (2006.01)
*G09G 3/34* (2006.01)

(52) U.S. Cl.
CPC ..... *G09G 3/3413* (2013.01); *G09G 2310/0235* (2013.01); *G09G 2320/0242* (2013.01); *G09G 2360/16* (2013.01)

(58) Field of Classification Search
CPC ..... G09G 3/34; G09G 3/36; G09G 5/02; G09G 5/10
USPC ..... 345/84, 87, 88, 102, 589–605, 690
See application file for complete search history.

(56) References Cited

U.S. PATENT DOCUMENTS

| | | | | |
|---|---|---|---|---|
| 7,952,549 | B2 * | 5/2011 | Lee et al. | 345/88 |
| 2004/0239814 | A1 * | 12/2004 | Hirashima et al. | 348/649 |
| 2004/0246275 | A1 * | 12/2004 | Yoshihara et al. | 345/690 |
| 2008/0203929 | A1 * | 8/2008 | Park et al. | 315/158 |
| 2012/0206475 | A1 * | 8/2012 | Bryant et al. | 345/589 |

* cited by examiner

*Primary Examiner* — Pegeman Karimi
(74) *Attorney, Agent, or Firm* — Li & Cai Intellectual Property (USA) Office

(57) ABSTRACT

A display control method used in a display apparatus with multiple colored light sources, wherein the colored light sources emit different color lights, the color cast sub frame in the frame of the display apparatus tends to a specific color, and the display control method comprises for the frame, increasing the specific color light source of the frame and decreasing the other color light source of the frame. For the white-tending sub frame of the frame, sub-pixel values of the specific color are decreased according to the increasing level of the specific color light source to generate modified sub-pixel values. For the white-tending frame, the modified sub-pixel values and the sub-pixel values of the other colors are increased according to the decreasing level of the other colored light sources.

20 Claims, 8 Drawing Sheets

DISPLAY CONTROL METHOD USED IN DISPLAY APPARATUS WITH MULTIPLE COLOR LIGHT SOURCES

BACKGROUND OF THE INVENTION

1. Field of the Invention

The present disclosure relates to a display apparatus; in particular, to a display control method used in a display apparatus having multiple colored light sources.

2. Description of Related Art

Nowadays the development of display technology grows fast, wherein liquid crystal displays (LCD) are wildly used to be video output apparatus of various kinds of electronic devices. In the markets, some of the LCDs have multiple colored light sources, such as a color sequential display having red, green, and blue colored light sources.

In the display apparatus having multiple colored light sources, a frame cycle could be divided into three sub cycles from a first sub-frame cycle to a third sub-frame cycle, and red, green, and blue colored lights would respectively be opened in the first, the second, and the third sub-frame cycle. Therefore, the display apparatus having multiple colored light sources may smoothly display colors of each pixel designated by the video data. Briefly speaking, the color and brightness of each pixel of the display apparatus having multiple colored light sources is composed by the value of red light, green light, and blue light that passes the liquid crystal at different time.

Besides, it is worth to mention that the most energy consuming part of a display apparatus is the colored light sources. Hence, it is necessary to properly adjust the brightness and intensity of the colored light sources to make the display apparatus more energy-saving and economical.

SUMMARY OF THE INVENTION

The present disclosure provides a display control method, adopted to a display apparatus having multiple colored light sources used to emit multiple color light of different colors, in which a frame of the display apparatus includes at least a color cast sub frame and at least a white-tending sub frame, wherein the color cast sub frame tends to at least a specific color that is able to be divided into at least one of the colored light of the one or more different colors. The method comprises steps of: for the frame, intensifying the colored light source of the specific color and reducing the colored light sources of colors other than the specific color; for the white-tending sub frame, decreasing a plurality of gray scale values corresponding to the specific color in the white-tending sub frame based on a level that the colored light source of the specific color is intensified, to generate a plurality of modified gray scale values; and for the white-tending sub frame, increasing the plurality of modified gray scale values and a plurality of gray scale values corresponding to the colors other than the specific color based on a level that the colored light sources of the colors other than the specific color are reduced.

In one embodiment of the present disclosure, the above-mentioned frame further includes at least a non-white-tending and non-color cast sub frame. The above-mentioned display control method further comprises steps of: for the non-white-tending and non-color cast sub frame, decreasing a plurality of gray scale values corresponding to the specific color in the non-white-tending and non-color cast sub frame based on a level that the colored light source of the specific color is intensified, to generate a plurality of modified gray scale values; and for the non-white-tending and non-color cast sub frame, increasing a plurality of gray scale values corresponding to the colors other than the specific color based on a level that the colored light sources of the colors other than the specific color are reduced.

Additionally, the present disclosure provides another display control method, adopted to a display apparatus having multiple colored light sources used to emit multiple color light of different colors, in which a frame of the display apparatus includes at least a color-lacking sub frame and at least a white-tending sub frame, wherein the color-lacking sub frame lacks for at least a specific color that is able to be divided into at least one of the colored light of the one or more different colors. The display control method comprises steps of: for the frame, reducing the colored light source of the specific color and intensifying the colored light sources of colors other than the specific color; for the white-tending sub frame, increasing a plurality of gray scale values corresponding to the specific color in the white-tending sub frame based on a level that the colored light source of the specific color is reduced, to generate a plurality of modified gray scale values; and for the white-tending sub frame, decreasing the plurality of modified gray scale values and a plurality of gray scale values corresponding to the colors other than the specific color based on a level that the colored light sources of the colors other than the specific color are intensified.

In one embodiment of the present disclosure, the above-mentioned frame further includes at least a non-white-tending and non-color-lacking sub frame. The above-mentioned display control method further comprises steps of: for the non-white-tending and non-color-lacking sub frame, increasing a plurality of gray scale values corresponding to the specific color in the non-white-tending and non-color-lacking sub frame based on a level that the colored light source of the specific color is reduced, to generate a plurality of modified gray scale values; and for the non-white-tending and non-color-lacking sub frame, decreasing a plurality of gray scale values corresponding to the colors other than the specific color in the non-white-tending and non-color-lacking sub frame based on a level that the colored light sources of the colors other than the specific color are intensified.

In summary, the present disclosure provides the display apparatus and the display control method. The display control method could reduce power consumption of the multiple colored light sources of the display apparatus. Furthermore, it does not require greater complexity to implement the display apparatus and the display control method, and thus the device and the method are suitable for mass producing related products and are highly practical.

For further understanding of the present disclosure, reference is made to the following detailed description illustrating the embodiments and examples of the present disclosure. The description is only for illustrating the present disclosure, not for limiting the scope of the claim.

DETAILED DESCRIPTION OF PREFERRED EMBODIMENTS

The aforementioned illustrations and following detailed descriptions are exemplary for the purpose of further explaining the scope of the instant disclosure. Other objectives and advantages related to the instant disclosure will be illustrated in the subsequent descriptions and appended drawings.

[Display Apparatus Embodiment]

Figure 1A:
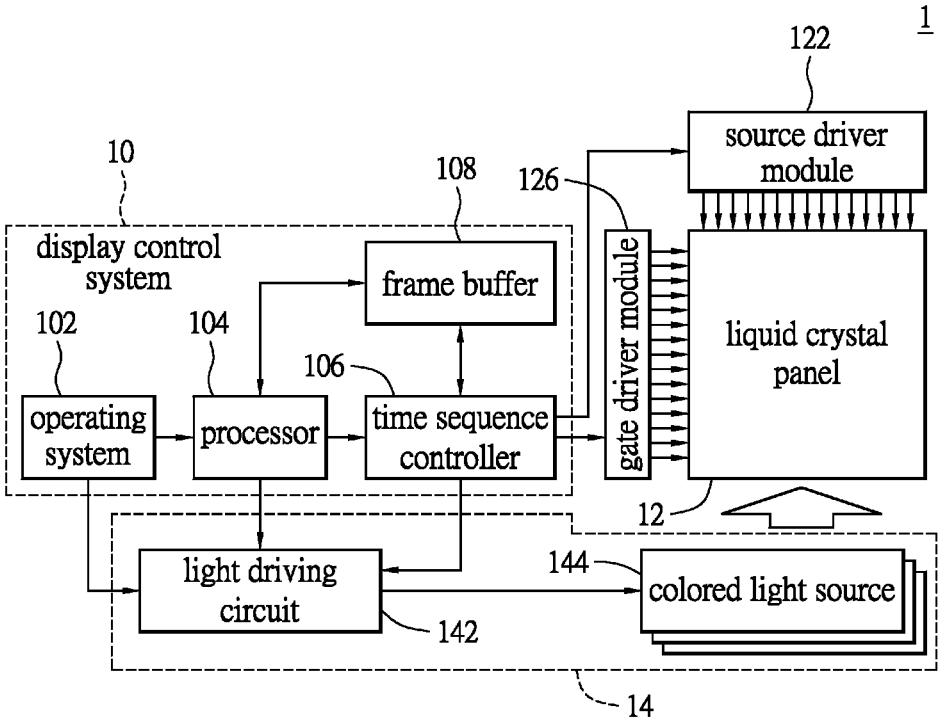
FIG. 1A shows a block diagram of a display apparatus according to one embodiment of the present disclosure.

Referring to FIG. 1A, it shows a block diagram of a display apparatus according to one embodiment of the present disclosure. The display apparatus 1 includes a display control system 10, a liquid crystal panel 12, a source driver module 122, a gate driver module 126, and a light source module 14. The display control system 10 is electronically connected to the source driver module 122, the gate driver module 126, and the light source module 14.

In the present embodiment, the display apparatus 1 has a plurality of light sources 144. Furthermore, the light source module 14 may be a backlight source module and front light source module (having front light guide panel). The light source module 14 includes a light source driving circuit 142 and multiple colored light sources 144. The multiple colored light sources 144 may be such as red, blue, green, white, cyan, purple, orange, and yellow. Majority of the multiple colored light sources 144 may include red, green, and blue light sources, or include red, green, blue, yellow, and white light sources. Meanwhile, the liquid crystal panel 12 may be selectively equipped with color filters.

The display control system 10 controls the light source driving circuit 142 to drive various colored light sources 144 and controls the gate driver module 126 and the source driver module 122. The light source driving circuit 142 receives a control signal from the display control system 10 to generate a driving current in order to control the multiple colored light sources 144 of the light source module 14 to be switched on or off, and to adjust brightness and intensity of the colored light emitted from the multiple colored light sources 144 of the light source module 14. In other words, the multiple colored lights emitted from the multiple colored light sources 144 include various light intensities (e.g. using 4 bits to create 16 kinds of light intensities), and the multiple colored lights emitted from the multiple colored light sources 144 have various light intensities to be adjusted. The light source module 14 may transmit the colored light generated by the colored light sources 144 to the liquid crystal panel 12. Each of the multiple colored light sources 144 is switched on or off, or modifies the brightness or intensity of the corresponding colored light according to the intensity of the received driving current.

The multiple colored light sources 144 may correspondingly provide multiple colored lights to a whole frame of the display apparatus. However, the whole frame may be divided into several physical independent sub frames, to which the multiple colored light sources 144 may correspondingly provide multiple colored light.

In short, the multiple colored light sources 144 that provide colored light to the several physical independent sub frames could be controlled independently. Each of the multiple colored light sources 144 may provide the colored light to the whole frame, or provide the colored light to different physical independent sub frames in a time-sharing manner. Meanwhile, the liquid crystal of the sub-pixel corresponding to the multiple colored light sources 144 would be controlled by section or in a time-sharing manner. For example, the liquid crystal of the sub-pixel corresponding to the multiple colored light sources 144 would be controlled in the time-sharing manner during the several sub frame cycles of the frame cycle.

The gate driver module 126 is controlled by the display control system 10 to generate gate driving signal, in order to switch an array of transistors of a thin-film transistor matrix of the liquid crystal panel 12 on or off. The source driver module 122 is controlled by the display control system 10 to generate a plurality of driving voltages corresponding to the video data to the array of transistors which is switched on, in order to control the liquid crystal of the pixels of the array and further adjust transmittance of the pixels of the array or adjust the driving voltages of the liquid crystals.

The display control system 10 includes an operating system 102, a processor 104, a time sequence controller 106, and a frame buffer 108. The operating system 102 is electronically connected with the processor 104 which electronically connects to the time sequence controller 106 and the frame buffer 108. The time sequence controller 106 is electronically connected with the frame buffer 108, the light source driving circuit 14, the source driver module 122, and the gate driver module 126. In other embodiments, the display control system 10 may further include external or built-in graphic card (not shown in FIG. 1A).

The operating system 102 may be an embedded operating system, common software operating systems, or a graphic card control system. The operating system 102 may control the processor 104 to process video data of the frames, and perform a display control method. Therefore, the display control system 10 could control to switch the multiple colored light sources 144 of the light source module 14 on/off and the brightness of the multiple colored light sources 144, as well as utilizing pulse width modulation (PWM) technique to change pulse frequency for adjusting the intensity and brightness of the colored light emitted from the multiple colored light source 144, so as to reduce the power consumption of the display apparatus 1.

Moreover, through the display control method, the display control system 10 may further adjust gray scale of each sub-pixel of the frame, in order to prevent white-tending sub frame and non-white-tending sub frame and non-color cast sub frame (or non-white-tending sub frame and non-color-lacking sub frame) from tending to (or lacking) at least one color due to adjustment of the intensity and brightness of the colored light emitted from the multiple colored light source 144.

In addition, in the present embodiment, the video data of the frame may be jointly processed and computed by the operating system 102, external or built-in graphic card, and the processor 104, or, on the other hand, be processed and computed simply by the operating system 102 or the graphic card to implement the display control method.

The frame buffer 108 is configured to receive and catch the video data of the frame to be shown. The time sequence controller 106 receives the outcome obtained via performing the display control method to process the video data of the frame from the processor 104, and controls the light source driving circuit 14, source driver module 122, and the gate drover module 126 based on the outcome, so that the switch-on/off of the multiple colored light of the light source module 16 may be controlled and the intensity and brightness of the colored light emitted from the multiple colored light source 144 may be controlled to save power. Furthermore, to prevent white-tending sub frame and non-white-tending sub frame and non-color cast sub frame (or non-white-tending sub frame and non-color-lacking sub frame) from tending to (or lacking) at least one color due to adjustment of the intensity and brightness of the colored light emitted from the multiple colored light source 144, the time sequence controller 106 may even adjust the gray scale value of each sub-pixel.

It is worth mentioning, the type of display apparatus 1 shown in FIG. 1A is not intended to limit the present invention. In the embodiments of the present invention, the display apparatus may be a TFT LCD device, a transmission or reflecting projecting display apparatus, a reflecting micro display apparatus, or display apparatus with multiple color light emitting diodes (LEDs), organic light emitting diodes (OLEDs), or electroluminescence (EL). Examples of transmission or reflecting projecting display apparatus may be high temperature poly-silicon (HTPS), low temperature poly-silicon (LTPS), or liquid crystal on silicon (LCOS) projecting display apparatus. The reflecting projecting display apparatus may further be digital light processing (DLP), LCOS, or MEMS mirror display apparatus. In addition, the colored light sources may be implemented via colored light laser sources, colored light LEDs, colored light EL, colored light OLEDs, cold cathode fluorescent lamp (CCFL), mercury lamp with color filters, helium lamp with color filters, or the mercury lamp or the helium lamp with color wheel.

[Another Display Apparatus Embodiment]

Figure 1B:
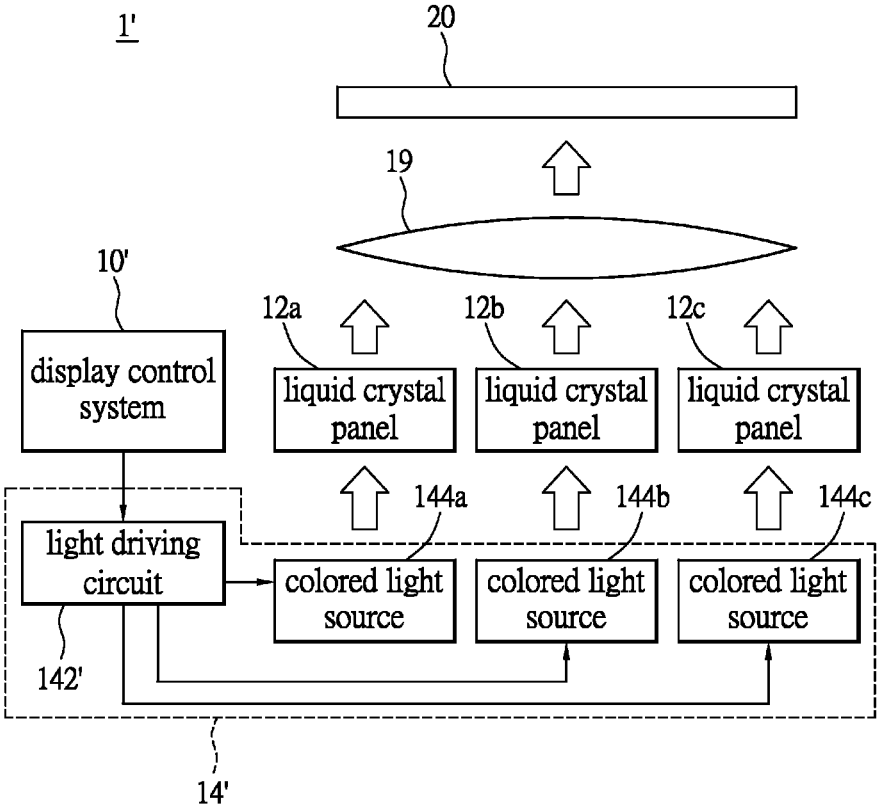
FIG. 1B shows a block diagram of a display apparatus according to another embodiment of the present disclosure.

Please refer to FIG. 1B which shows a block diagram of a display apparatus according to another embodiment of the present disclosure. The display apparatus 1' shown in FIG. 1B is a HTPS transmission projecting display apparatus. The display apparatus 1' includes a display control system 10', a source driver module (not shown in FIG. 1B), a gate driver module (not shown in FIG. 1B), a light source module 14', liquid crystal panels 12*a*-12*c*, and a converging lens 19. The light source module 14' includes a light source driving circuit 142' and multiple colored light sources 144*a*-144*c*. The display control system 10' and the light source driving circuit 142' are substantially the same as the display control system 10 and the light source driving circuit 142 shown in FIG. 1A, and therefore details of which would be omitted in this embodiment. The source driver module and the gate driver module respectively includes multiple source driver modules and multiple gate driver modules corresponding to the liquid crystal panels 12*a*-12*c*, which are basically the same as the source driver module 122 and the gate driver module 126 shown in FIG. 1A, and therefore the details would be omitted in this embodiment.

In FIG. 1B, multiple light-color sources 144*a*-144*c* are used to generate different colors to the liquid crystal panels 12*a*-12*c*. The colored light penetrating the liquid crystal panels 12*a*-12*c* would be collected and converged by the converging lens 19, to project the image to a screen 20. In summary, the display control method in the embodiment may be implemented to various kinds of display apparatus, and types of the display apparatus are not meant to be a limitation of the present disclosure.

The following embodiments would explain more on how the above-mentioned display control method may control the on and off the multiple colored light sources of the light source module, adjust the intensity or brightness of the color light emitted from the multiple colored light sources, or the gray scale values of the sub-pixels in the frame by processing and computing the video data of the frame.

[Embodiment of a Display Control Method]

Figure 2A:
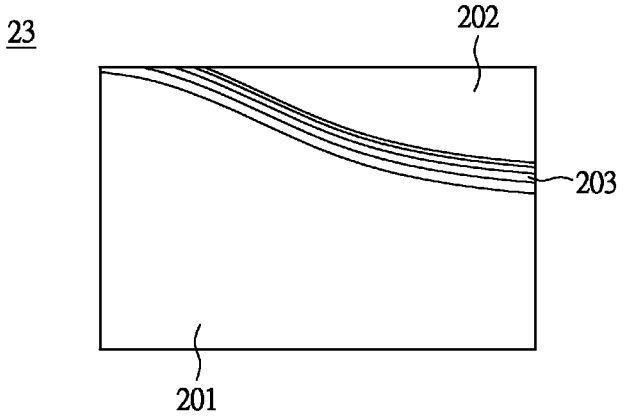
FIG. 2A shows an illustrative diagram of a frame having a white-tending sub frame and a color cast sub frame according to an embodiment of the present disclosure.
Figure 2B:
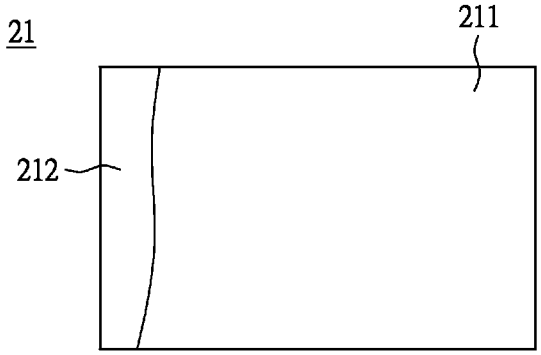
FIG. 2B shows an illustrative diagram of a frame having a white-tending sub frame, a non-white-tending and non-color cast sub frame, and a color cast sub frame according to an embodiment of the present disclosure.
Figure 2C:
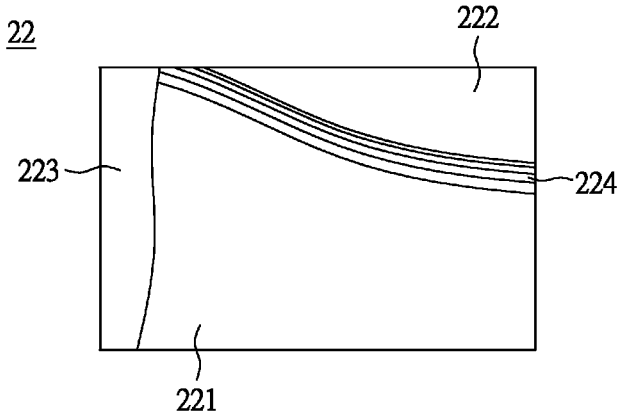
FIG. 2C shows an illustrative diagram of a frame having a non-white-tending and non-color cast sub frame and a color cast sub frame according to an embodiment of the present disclosure.

Please refer to FIGS. 2A to 2C. FIG. 2A depicts an illustrative diagram of a frame having a white-tending sub frame and a color cast sub frame according to an embodiment of the present disclosure. FIG. 2B shows an illustrative diagram of a frame having a white-tending sub frame, a non-white-tending and non-color cast sub frame, and a color cast sub frame according to an embodiment of the present disclosure. FIG. 2C refers to an illustrative diagram of a frame having a non-white-tending and non-color cast sub frame and a color cast sub frame according to an embodiment of the present disclosure.

In FIG. 2A, the frame 23 basically tends to a specific color and includes the color cast sub frame 201 and the white-tending sub frame 202. The specific color may be divided into at least one of the colors corresponding to the multiple colored light sources. The color cast sub frame 201 tends to said specific color, and the white-tending sub frame 202 tends to white.

Because the color cast sub frame 201 tends to the specific color, the colored light sources corresponding to the specific light may be intensified and the colored light sources corresponding to colors other than the specific color may be reduced for the color cast sub frame 201, in order to save power consumption. Because the color light of the specific color is intensified and the color light of the colors other than the specific color is reduced, the white-tending sub frame 202 may become slightly tend to the specific color, and correspondingly, the color temperature of the white-tending sub frame 202 may become slightly higher or lower.

Next, to prevent the white-tending sub frame 202 from tending to the specific color, the gray scale values of each sub-pixel of the specific color in the white-tending sub frame 202 may be decreased based on the level that the colored light source corresponding to the specific color is intensified. Then the modified gray scale values of each sub-pixel of the specific color in the white-tending sub frame 202 and the gray scale values each sub-pixel of colors other than the specific color in the white-tending sub frame 202 may be increased based on the level that the colored light sources corresponding to colors other than the specific color are reduced.

Finally, the original gray scale values of each sub-pixel of the specific color and the original gray scale values of each sub-pixel of the colors other than the specific color of the white-tending sub frame 202 are replaced by the above-mentioned modified gray scale values of each sub-pixel of the specific color and the modified gray scale values of each sub-pixel of the colors other than the specific color of the white-tending sub frame 202.

In FIG. 2B, the frame 21 tends to a specific color and includes a color cast sub frame 211 and a non-white-tending and non-color cast sub frame 212. The color cast sub frame 211 tends to said specific color, and the non-white-tending and non-color cast sub frame 212 don't tend to the specific color neither white color.

Because the frame 21 tends to the specific color, the colored light sources corresponding to the specific light may be intensified and the colored light sources corresponding to colors other than the specific color may be reduced for the frame 21 in order to save power consumption. Due to the colored light of the specific color is intensified and the colored light of the colors other than the specific color is reduced, the non-white-tending and non-color cast sub frame 212 may become slightly tend to the specific color.

Next, to prevent the non-white-tending and non-color cast sub frame 212 from tending to the specific color, the gray scale values of each sub-pixel of the specific color in the non-white-tending and non-color cast sub frame 212 may be decreased based on the level that the colored light source corresponding to the specific color is intensified to generate a plurality of modified gray scale values. Then the gray scale values of each sub-pixel of colors other than the specific color in the non-white-tending and non-color cast sub frame 212 may be increased based on the level that the colored light sources corresponding to colors other than the specific color are reduced.

At last, the original gray scale values of each sub-pixel of the specific color and the original gray scale values of each sub-pixel of the colors other than the specific color of the non-white-tending and non-color cast sub frame 212 are replaced by the above-mentioned modified gray scale values of each sub-pixel of the specific color and the modified gray scale values of each sub-pixel of the colors other than the specific color of the non-white-tending and non-color cast sub frame 212.

In FIG. 2C, the frame 22 substantially tends to a specific color and includes the color cast sub frame 221, the white-tending sub frame 222, and the non-white-tending and non-color cast sub frame 223. The color cast sub frame 221 tends to said specific color, while the white-tending sub frame 222 tends to white, and the non-white-tending and non-color cast sub frame 223 don't tend to the specific color neither white.

Because the frame 22 tends to the specific color, the colored light sources corresponding to the specific light may be intensified and the colored light sources corresponding to colors other than the specific color may be reduced for the frame 22 in order to save power consumption. Due to the color light of the specific color is intensified and the color light of the colors other than the specific color is reduced, the white-tending sub frame 221 and the non-white-tending and non-color cast sub frame 223 may become slightly tend to the specific color.

The modification made to the gray scale value of the white-tending sub frame 222 is identical to the way made to the white-tending sub frame 202 shown in FIG. 2A, meanwhile, the modification made to the gray scale value of the non-white-tending and non-color cast sub frame 223 is identical to the way made to the non-white-tending and non-color cast sub frame 212 shown in FIG. 2B. Therefore the same modification process would not be repeated again.

It is worth to mention, the frame 22 may be divided into several physical independent sub frames, wherein each of the physical independent sub frames corresponds to part of the multiple colored light sources. Furthermore, the color cast sub frame 221 may be composed by part of the several physical independent sub frames, the white-tending sub frame 222 composed by other part of the several physical independent sub frames, and the non-white-tending and non-color cast sub frame 223 be composed by another part of the several physical independent sub frames.

Moreover, in the present disclosure, intergrade zones 203 and 204 may be prepared between the boundary of the white-tending sub frame and the color cast sub frame. So that Chroma and the gray scale values of the sub-pixels of the specific color of the white-tending sub frame may be gradually changed in a tiered manner to those of the color cast sub frame. Interval of the tiers may be smaller than 10% of the Chroma and the gray scale values of the sub-pixels of the specific color, so that the changes presented between the edges of the white-tending sub frame and the color cast sub frame may be continuous instead of discrete. Also, an intergrade zone may be prepared between the edges of the white-tending sub frame and the non-white-tending and non-color cast sub frame. So that Chroma and the gray scale values of the sub-pixels of the color other than the specific color of the white-tending sub frame may be gradually changed in a tiered manner to those of the non-white-tending and non-color cast sub frame. Interval of the tiers may be smaller than 10% of the Chroma and the gray scale values of the sub-pixels of the color other than the specific color, so that the changes presented between the edges of the white-tending sub frame and the color cast sub frame may be continuous instead of discrete.

Thus, the multiple colored light sources may be dynamically switched on and off as well as the brightness and intensity being adjusted according to color tending in the frame 20-22, so as to save more power and energy. Furthermore, when the Chroma and gray scale values of each sub-pixel of the above-mentioned white-tending sub frames 202 and 222 are adjusted, the sub frame 202 and 222 would tend to white. Meanwhile, the color temperature may be large than or equal to 4000K and smaller than or equal to 12000K. In other words, the color temperature would be between 4000K and 12000K.

Figure 3:
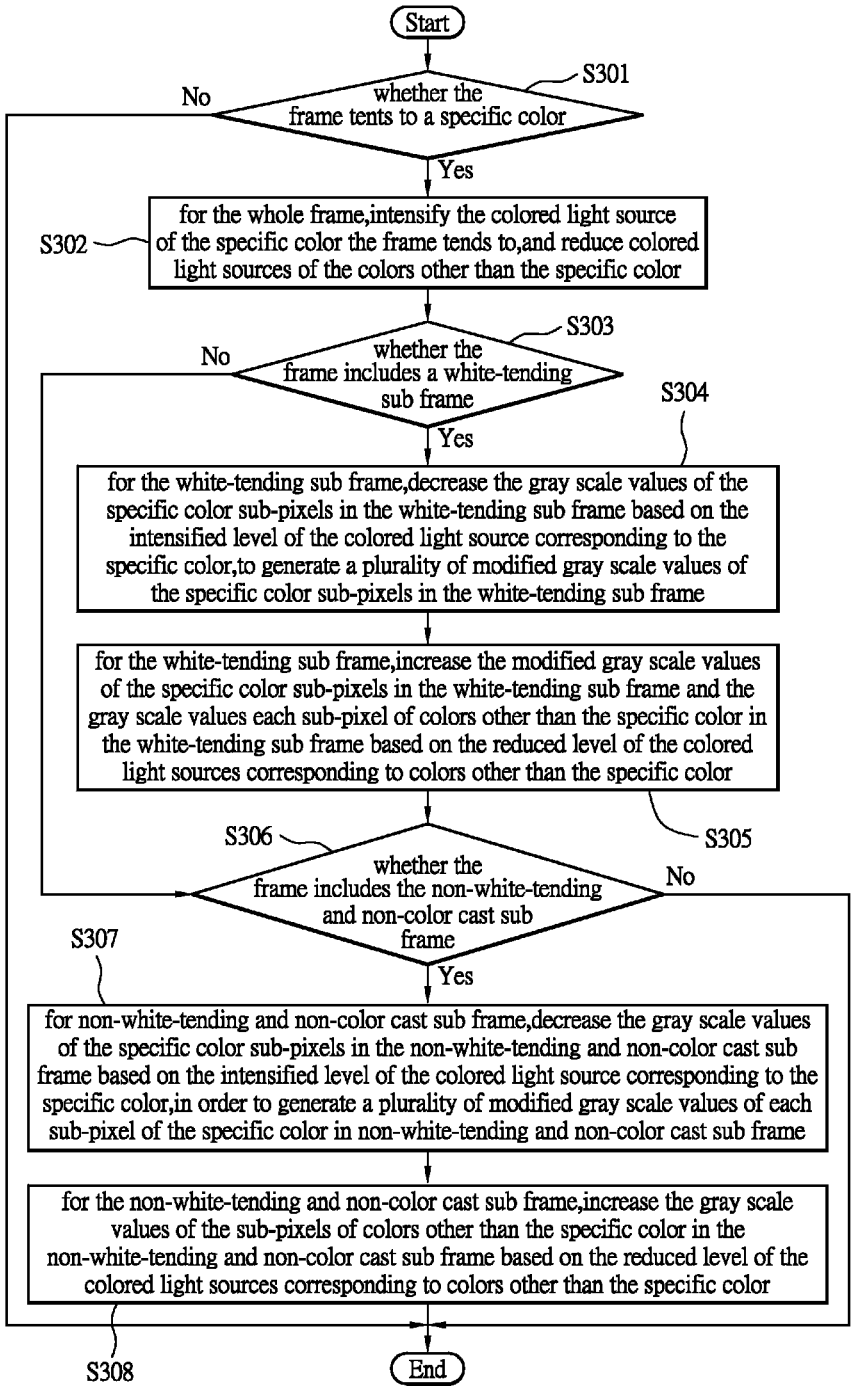
FIG. 3 shows a flow chart of a display control method according to one embodiment of instant disclosure.

Next, based on the above-mentioned examples, one of the display control methods according to the embodiments of the present disclosure may be summarized. Please refer to FIG. 3 which shows a flow diagram of a display control method according to one embodiment of the present disclosure. Firstly, in step S301, the display control system would receive video data of a frame, and determine whether the frame tends to a specific color. If the frame tends to the specific color step S302 is performed. Otherwise, if the frame does not tend to the specific color, the switch-on/off of the multiple colored light sources and the intensity or brightness of the color light need no adjustment, and the display control method may be exited.

In step S302, for the whole frame, the display control system intensifies the colored light source of the specific color the frame tends to, and reduces colored light sources of the colors other than the specific color. Next, in step S303, the display control system determines whether the frame includes the white-tending sub frame. When the white-tending sub frame is included, step S304 is subsequently performed. Otherwise, when the white-tending sub frame is not included, processes for Chroma and the gray scale values of the sub-pixels of the white-tending sub frame would be not necessary, and step S306 is followed.

In step S304, for the white-tending sub frame, the display control system decreases the gray scale values of each sub-pixel of the specific color in the white-tending sub frame based on the level that the colored light source corresponding to the specific color is intensified, in order to generate a plurality of modified gray scale values of each sub-pixel of the specific color in the white-tending sub frame. Precisely speaking, for the white-tending sub frame, the display control system refers to a first look-up table (LUT) or utilizes a first equation according to the level that the colored light source corresponding to the specific color is intensified and the gray scale values of the plurality of the sub-pixels of the specific color to generate the plurality of modified gray scale values.

Next, in step S305, for the white-tending sub frame, the display control system increases the modified gray scale values of each sub-pixel of the specific color in the white-tending sub frame and the gray scale values each sub-pixel of colors other than the specific color in the white-tending sub frame based on the level that the colored light sources corresponding to colors other than the specific color are reduced. The display control system then replaces the original gray scale values of each sub-pixel of the specific color and the original gray scale values of each sub-pixel of the colors other than the specific color of the white-tending sub frame by the modified gray scale values of each sub-pixel of the specific color and the modified gray scale values of each sub-pixel of the colors other than the specific color of the white-tending sub frame.

More specifically, the display control system refers to at least a second look-up table or utilizes at least a second equation according to the level that the colored light sources corresponding to colors other than the specific color are reduced, the plurality of modified gray scale values of the sub-pixels, and the plurality of scale values of the sub-pixels corresponding to the colors other than the specific color to increase the plurality of modified gray scale values of the sub-pixels and the gray scale values of the sub-pixels of the colors other than the specific color in the white-tending sub frame. It is worth mentioning, the second look-up table or the second equation used by the gray scale values of the sub-pixels of different colors may be identical as well as different, which is not a limitation for the present disclosure.

In step S306, the display control system determines whether the frame includes the non-white-tending sub frame or non-color cast sub frame. When the non-white-tending and non-color cast sub frame is included, the system goes to step S307. On the other hand, when the non-white-tending and non-color cast sub frame are not included, processes for gray scale values of the sub-pixels in the non-white-tending and non-color cast sub frame would be not necessary, and the display control method may be exited.

In step S307, for non-white-tending and non-color cast sub frame, the display control system decreases the gray scale values of each sub-pixel of the specific color in the non-white-tending and non-color cast sub frame based on the level that the colored light source corresponding to the specific color is intensified, in order to generate a plurality of modified gray scale values of each sub-pixel of the specific color in non-white-tending and non-color cast sub frame. Precisely speaking, for the non-white-tending and non-color cast sub frame, the display control system refers to a third look-up table or utilizes a third equation according to the level that the colored light source corresponding to the specific color is intensified and the gray scale values of the plurality of the sub-pixels of the specific color, to generate the plurality of modified gray scale values.

In step S308, for the non-white-tending and non-color cast sub frame, the display control system increases the gray scale values of the sub-pixels of colors other than the specific color in the non-white-tending and non-color cast sub frame based on the level that the colored light sources corresponding to colors other than the specific color are reduced. The display control system then replaces the original gray scale values of each sub-pixel of the specific color and the original gray scale values of each sub-pixel of the colors other than the specific color of the non-white-tending and non-color cast sub frame by the modified gray scale values of each sub-pixel of the specific color and the modified gray scale values of each sub-pixel of the colors other than the specific color of the non-white-tending and non-color cast sub frame.

More specifically speaking, for the non-white-tending and non-color cast sub frame, the display control system refers to at least a fourth look-up table or utilizes at least a fourth equation according to the level that the colored light sources corresponding to colors other than the specific color are reduced and the plurality of gray scale values of the sub-pixels corresponding to the colors other than the specific color to increase the plurality of modified gray scale values of the sub-pixels and the gray scale values of the sub-pixels of the colors other than the specific color in the non-white-tending and non-color cast sub frame. It is worth mentioning, the fourth look-up table or the fourth equation used by the gray scale values of the sub-pixels of different colors may be identical as well as different, which is not a limitation to the present disclosure.

In addition, in the present embodiment, the order of steps S303-S305 and steps S306-308 may be exchanged. In other words, the system may firstly determine whether the frame includes the non-white-tending and non-color cast sub frame, and process the gray scale values of the sub-pixels in the non-white-tending and non-color cast sub frame, then determine whether the frame includes the white-tending sub frame and process the gray scale values of the sub-pixels in the white-tending sub frame. In summary, sequences of the steps are not meant to limit the present disclosure.

Figure 4A:
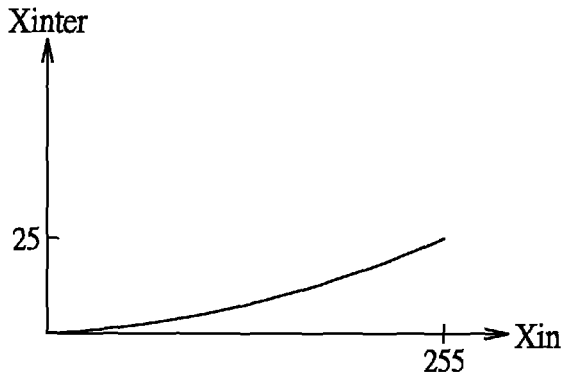
FIG. 4A shows a curve graph of gray scale values of sub-pixel of a specific color versus modified gray scale values of sub-pixels modified based on the intensified level of the colored light source of the specific color according to one embodiment of the present disclosure.
Figure 4B:
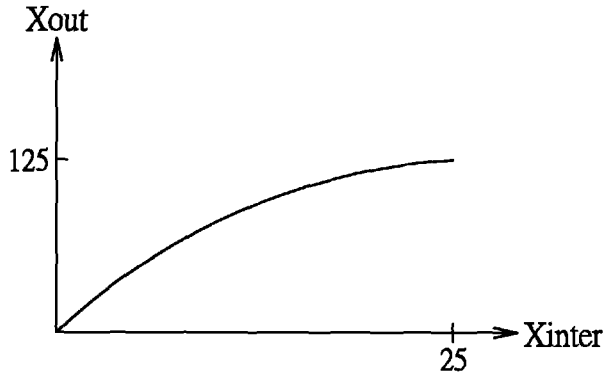
FIG. 4B shows a curve graph of modified gray scale values of sub-pixel of a specific color versus modified gray scale values of sub-pixels increased based on the reduced level of the colored light sources of the colors other than the specific color according to one embodiment of the present disclosure.
Figure 4C:
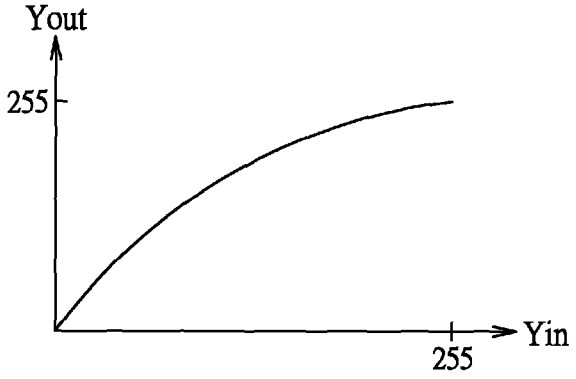
FIG. 4C shows a curve graph of gray scale values of sub-pixel of the colors other than the specific color versus modified gray scale values of sub-pixels increased based on the reduced level of the colored light source of the colors other than the specific color according to one embodiment of the present disclosure.

Next, please refer to FIGS. 4A to 4C. FIG. 4A shows a curve graph of the gray scale values of the sub-pixel of the specific color and the modified gray scale values of the sub-pixels modified based on the intensified level of the colored light source of the specific color according to one embodiment of the present disclosure. FIG. 4B shows a curve diagram of the modified gray scale values of the sub-pixel of the specific color and the modified gray scale values of the sub-pixels increased based on the reduced level of the colored light sources of the colors other than the specific color according to one embodiment of the present disclosure. FIG. 4C shows a curve diagram of the gray scale values of the sub-pixel of the colors other than the specific color and the modified gray scale values of the sub-pixels increased based on the reduced level of the colored light source of the colors other than the specific color according to one embodiment of the present disclosure.

For example, when the multiple colored light sources include red, green, and blue light sources, and the red light source in the frame is intensified 10 times while the green and the blue light sources are reduced 5 times, the range of gray scale values of the sub-pixels of the specific color would become 0-25 from the range of 0-255 when the gray scale values of the sub-pixels of the specific color in the non-white-tending and non-color cast sub frame and the white-tending sub frame are reduced according to the intensified level of the colored light sources of the specific color, as shown in FIG. 4A.

As shown in FIG. 4B, when the modified gray scale values of the sub-pixels of the specific color in the white-tending sub frame is increased based on the reduced level of the colored light sources of the colors other than the specific color, the range of the modified gray scale values of the sub-pixels of the specific color in the white-tending sub frame would become 0-255 from 0-25. As shown in FIG. 4C, when the gray scale values of the sub-pixels of the colors other than the specific color in the non-white-tending and non-color cast sub frame are increased based on the level that the colored light sources of the colors other than the specific color are reduced, the range of the gray scale values of the sub-pixels of the colors other than the specific color in the non-white-tending and non-color cast sub frame would not change and maintain 0-255.

Please note that when the modified gray scale values of the sub-pixels in the white-tending sub frame are increased based on the level that the colored light sources of the colors other than the specific color are reduced, the modified gray scale values are not equal to the original gray scale values of the sub-pixel of the specific color in the white-tending sub frame, neither the modification level of the gray scale values of the sub-pixels is inversely proportional to the adjustment level of colored light sources.

[Another Embodiment of a Display Control Method]

Figure 5A:
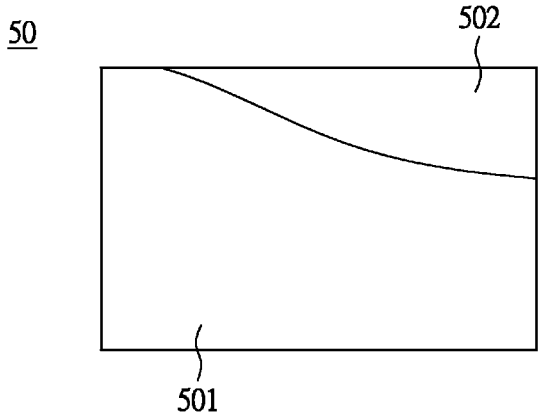
FIG. 5A shows an illustrative diagram of a frame having a white-tending sub frame and a color-lacking sub frame according to an embodiment of the present disclosure.
Figure 5B:
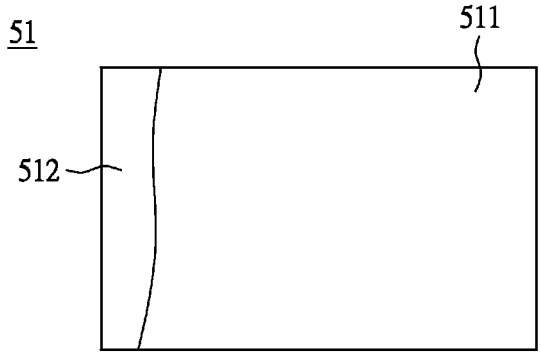
FIG. 5B shows an illustrative diagram of a frame having a white-tending sub frame, a non-white-tending and non-color-lacking sub frame, and a color-lacking sub frame according to an embodiment of the present disclosure.
Figure 5C:
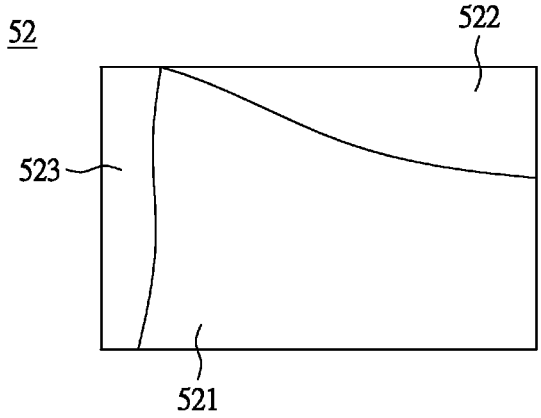
FIG. 5C shows an illustrative diagram of a frame having a non-white-tending and non-color-lacking sub frame and a color-lacking sub frame according to an embodiment of the present disclosure.

Please refer to FIGS. 5A-5C. FIG. 5A depicts an illustrative diagram of a frame having a white-tending sub frame and a color-lacking sub frame according to an embodiment of the present disclosure. FIG. 5B shows an illustrative diagram of a frame having a white-tending sub frame, a non-white-tending and non-color-lacking sub frame, and a color-lacking sub frame according to an embodiment of the present disclosure. FIG. 5C refers to an illustrative diagram of a frame having a non-white-tending and non-color-lacking sub frame and a color-lacking sub frame according to an embodiment of the present disclosure.

In FIG. 5A, the frame 50 lacks for a specific color, and includes a color-lacking sub frame 501 and a white-tending sub frame 502. The specific color may be divided into at least one of the colors corresponding to the multiple colored light sources. The color-lacking sub frame 501 lacks said specific color. Meanwhile, the white-tending sub frame 502 tends to white.

Because the color-lacking sub frame 501 lacks the specific color, the colored light sources corresponding to the specific light may be reduced and the colored light sources corresponding to colors other than the specific color may be intensified for the color-lacking sub frame 501 in order to save power consumption. Additionally, because the color light of the specific color is reduced and the color light of the colors other than the specific color is intensified, the white-tending sub frame 502 may slightly lack the specific color, and correspondingly, the color temperature of the white-tending sub frame 502 may become slightly higher or lower.

Next, to prevent the white-tending sub frame 502 from lacking for the specific color, the gray scale values of each sub-pixel of the specific color in the white-tending sub frame 502 may be increased based on the level that the colored light source corresponding to the specific color is reduced, in order to generate a plurality of modified gray scale values of the sub-pixels. Then the modified gray scale values of the sub-pixels of the specific color in the white-tending sub frame 502 and the gray scale values each sub-pixel of colors other than the specific color in the white-tending sub frame 502 may be decreased based on the level that the colored light sources corresponding to colors other than the specific color are intensified.

Finally, the original gray scale values of each sub-pixel of the specific color and the original gray scale values of each sub-pixel of the colors other than the specific color in the white-tending sub frame 502 are replaced by the above-mentioned modified gray scale values of each sub-pixel of the specific color and the modified gray scale values of each sub-pixel of the colors other than the specific color of the white-tending sub frame 502.

In FIG. 5B, the frame 51 lacks a specific color, and includes a color-lacking sub frame 511 and a non-white-tending and non-color-lacking sub frame 512. The color-lacking sub frame 511 lacks said specific color, and the non-white-tending and non-color-lacking sub frame 512 doesn't lack the specific color or tend to white color.

Because the frame 51 lacks for the specific color, the colored light sources corresponding to the specific light may be reduced and the colored light sources corresponding to colors other than the specific color may be intensified for the frame 51 in order to save power consumption. Because the color light of the specific color is reduced and the color light of the colors other than the specific color is intensified, the non-white-tending and non-color-lacking sub frame 512 may slightly lack for the specific color.

Next, to prevent the non-white-tending and non-color-lacking sub frame 512 from lacking for the specific color, the gray scale values of each sub-pixel of the specific color in the non-white-tending and non-color-lacking sub frame 512 may be increased based on the level that the colored light source corresponding to the specific color is reduced to generate a plurality of modified gray scale values. Then the gray scale values of each sub-pixel of colors other than the specific color in the non-white-tending and non-color-lacking sub frame 512 may be decreased based on the level that the colored light sources corresponding to colors other than the specific color are intensified.

At last, the original gray scale values of each sub-pixel of the specific color and the original gray scale values of each sub-pixel of the colors other than the specific color in the non-white-tending and non-color-lacking sub frame 512 are replaced by the above-mentioned modified gray scale values of each sub-pixel of the specific color and the modified gray scale values of each sub-pixel of the colors other than the specific color of the non-white-tending and non-color-lacking sub frame 512.

In FIG. 5C, the frame 52 lacks for a specific color and includes a color-lacking sub frame 521, the white-tending sub frame 522, and a non-white-tending and non-color-lacking sub frame 523. The color-lacking sub frame 521 lacks for said specific color, while the white-tending sub frame 522 tends to white, and the non-white-tending and non-color-lacking sub frame 523 doesn't lack for the specific color neither tends to white.

Because the frame 52 lacks for the specific color, the colored light sources corresponding to the specific light may be reduced and the colored light sources corresponding to colors other than the specific color may be intensified in the frame 52 in order to save power consumption. Because the color light of the specific color is intensified and the color light of the colors other than the specific color is reduced, the white-tending sub frame 521 and the non-white-tending and non-color-lacking sub frame 523 may slightly lack for the specific color.

The modification made to the gray scale value of the white-tending sub frame 522 is identical to the way made to the white-tending sub frame 502 shown in FIG. 5A, meanwhile, the modification made to the gray scale value of the non-white-tending and non-color-lacking sub frame 523 is identical to the way made to the non-white-tending and non-color-lacking sub frame 512 shown in FIG. 5B. Therefore the same modification process would not be repeated again.

It is worth to mention, the frame 52 may be divided into several physical independent sub frames, wherein each of the physical independent sub frames corresponds to part of the multiple colored light sources. Furthermore, the color-lacking sub frame 521 may be composed by part of the several physical independent sub frames, the white-tending sub frame 522 may be composed by other part of the several physical independent sub frames, and the non-white-tending and non-color-lacking sub frame 523 may be composed by another part of the several physical independent sub frames.

Moreover, in the present disclosure, an intergrade zone may be prepared between the boundary of the white-tending sub frame and the color-lacking sub frame. In this regard, Chroma and the gray scale values of the sub-pixels of the specific color of the white-tending sub frame may be gradually changed in a tiered manner to those of the color-lacking sub frame. Intervals of the tiers may be smaller than 10% of the Chroma and the gray scale values of the sub-pixels of the specific color, so that the changes presented between the boundary of the white-tending sub frame and the color-lacking sub frame may be continuous instead of discrete. Also, an intergrade zone may be prepared between the edges of the white-tending sub frame and the non-white-tending and non-color-lacking sub frame. Thus Chroma and the gray scale values of the sub-pixels of the color other than the specific color of the white-tending sub frame may be gradually changed in a tiered manner to those of the non-white-tending and non-color-lacking sub frame. Intervals of the tiers may be smaller than 10% of the Chroma and the gray scale values of the sub-pixels of the color other than the specific color, so that the changes presented between the edges of the white-tending sub frame and the non-white-tending and non-color-lacking sub frame may be continuous instead of discrete. Thus, the multiple colored light sources may be dynamically switched on and off as well as the brightness and intensity being adjusted according to color lacking in the frame 50-52, so as to save more power and energy. Furthermore, when the Chroma and gray scale values of each sub-pixel of the above-mentioned white-tending sub frames 502 and 522 are adjusted, the sub frame 502 and 522 would tend to white. Meanwhile, the color temperature may be larger than or equal to 4000K and smaller than or equal to 12000K. In other words, the color temperature would be between 4000K and 12000K.

Figure 6:
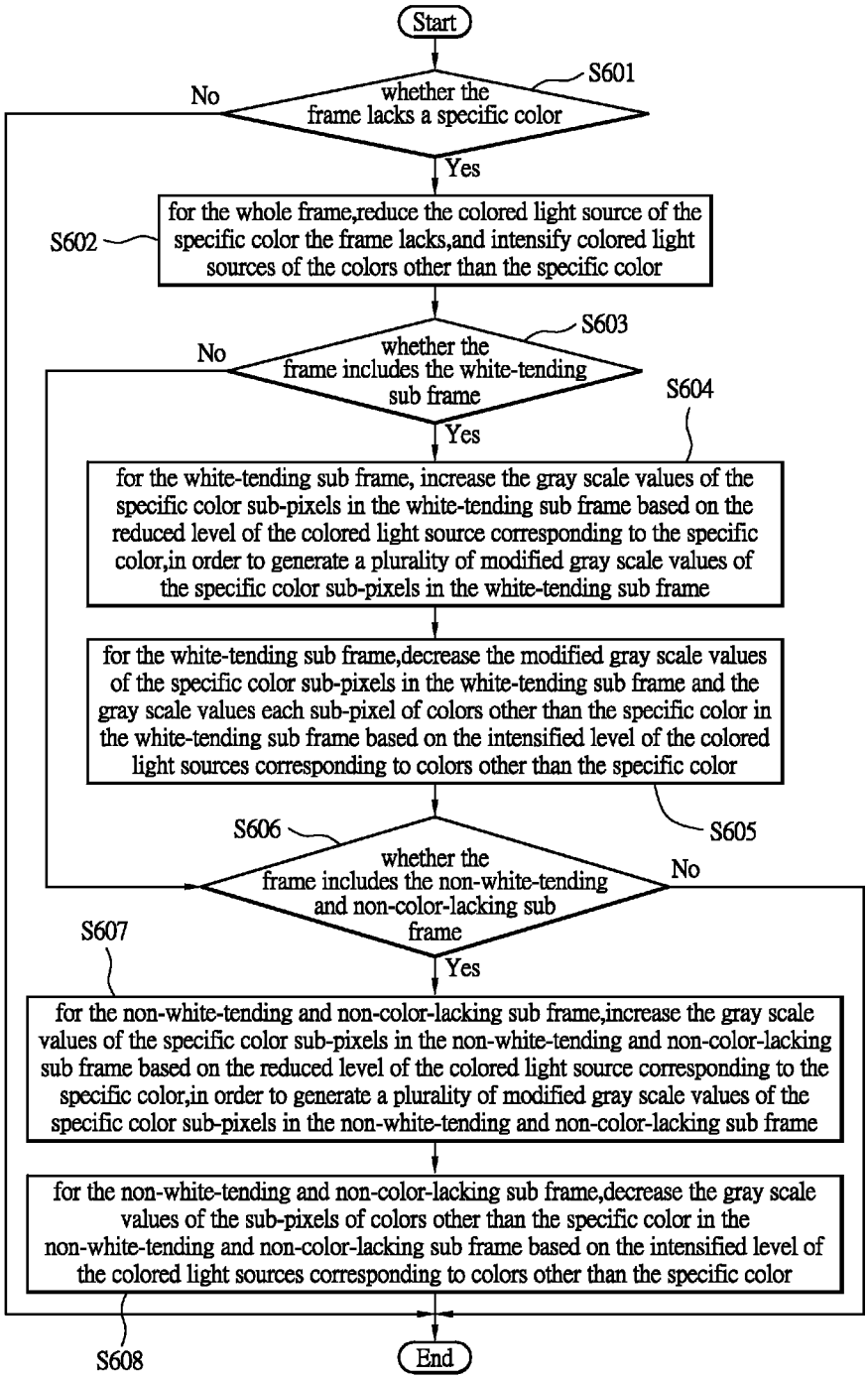
FIG. 6 shows a flow chart of display control method according to another embodiment of instant disclosure.

Next, based on the above-mentioned examples, one of the display control methods according to the embodiments of the present disclosure may be summarized. Please refer to FIG. 6 which shows a flow diagram of a display control method according to one embodiment of the present disclosure. Firstly, in step S601, the display control system would receive video data of a frame, and determine whether the frame lacks a specific color. If the frame lacks for the specific color, step S602 is performed. Otherwise, if the frame does not lack for the specific color, the switch-on/off of the multiple colored light sources and the intensity or brightness of the color light need not to be adjusted, and the display control method may be exited.

In step S602, for the entire frame, the display control system reduces the colored light source of the specific color the frame lacks, and intensified colored light sources of the colors other than the specific color. Next, in step S603, the display control system determines whether the frame includes the white-tending sub frame. When the white-tending sub frame is included, step S604 is subsequently performed. Otherwise, when the white-tending sub frame is not included, processes for Chroma and the gray scale values of the sub-pixels of the white-tending sub frame would not be necessary, and step S606 carries on.

In step S604, for the white-tending sub frame, the display control system increases the gray scale values of each sub-pixel of the specific color in the white-tending sub frame based on the level that the colored light source corresponding to the specific color is reduced in order to generate a plurality of modified gray scale values of each sub-pixel of the specific color in the white-tending sub frame. Precisely speaking, for the white-tending sub frame, the display control system refers to a fifth look-up table or utilizes a fifth equation according to the level that the colored light source corresponding to the specific color is reduced and the gray scale values of the plurality of the sub-pixels of the specific color to generate the plurality of modified gray scale values.

Next, in step S605, for the white-tending sub frame, the display control system decreases the modified gray scale values of each sub-pixel of the specific color in the white-tending sub frame and the gray scale values each sub-pixel of colors other than the specific color in the white-tending sub frame based on the level that the colored light sources corresponding to colors other than the specific color are intensified. The display control system then replaces the original gray scale values of each sub-pixel of the specific color and the original gray scale values of each sub-pixel of the colors other than the specific color of the white-tending sub frame by the modified gray scale values of each sub-pixel of the specific color and the modified gray scale values of each sub-pixel of the colors other than the specific color of the white-tending sub frame.

More specifically speaking, the display control system refers to at least a sixth look-up table or utilizes at least a sixth equation according to the level that the colored light sources corresponding to the colors other than the specific color are intensified, the plurality of modified gray scale values of the sub-pixels, and the plurality of gray scale values of the sub-pixels corresponding to the colors other than the specific color to decrease the plurality of modified gray scale values of the sub-pixels and the gray scale values of the sub-pixels of the colors other than the specific color in the white-tending sub frame. It is worth mentioning, the sixth look-up table or the sixth equation used by the gray scale values of the sub-pixels of different colors may be identical as well as different, which is not a limitation to the present disclosure.

In step S606, the display control system determines whether the frame includes the non-white-tending and non-color-lacking sub frame. When the non-white-tending and non-color-lacking sub frame is included, the system goes to step S607. On the other hand, when the non-white-tending and non-color-lacking sub frame is not included, processes for gray scale values of the sub-pixels in the non-white-tending and non-color-lacking sub frame would not be necessary, and the display control method may be exited.

In step S607, for the non-white-tending and non-color-lacking sub frame, the display control system increases the gray scale values of each sub-pixel of the specific color in the non-white-tending and non-color-lacking sub frame based on the level that the colored light source corresponding to the specific color is reduced, in order to generate a plurality of modified gray scale values of each sub-pixel of the specific color in the non-white-tending and non-color-lacking sub frame. Precisely speaking, for the non-white-tending and non-color-lacking sub frame, the display control system refers to a seventh look-up table or utilizes a seventh equation according to the level that the colored light source corresponding to the specific color is reduced and the gray scale values of the plurality of the sub-pixels of the specific color for reducing the plurality of gray scale values of each sub-pixel of the specific color in the non-white-tending and non-color-lacking sub frame to generate the plurality of modified gray scale values.

In step S608, for the non-white-tending and non-color-lacking sub frame, the display control system decreases the gray scale values of the sub-pixels of colors other than the specific color in the non-white-tending and non-color-lacking sub frame based on the level that the colored light sources corresponding to colors other than the specific color are intensified. The display control system then replaces the original gray scale values of each sub-pixel of the specific color and the original gray scale values of each sub-pixel of the colors other than the specific color in the non-white-tending and non-color-lacking sub frame by the modified gray scale values of each sub-pixel of the specific color and the modified gray scale values of each sub-pixel of the colors other than the specific color in the non-white-tending and non-color-lacking sub frame.

More specifically speaking, for the non-white-tending and non-color-lacking sub frame, the display control system refers to at least an eighth look-up table or utilizes at least an eighth equation according to the level that the colored light sources corresponding to colors other than the specific color are intensified and the plurality of gray scale values of the sub-pixels corresponding to the colors other than the specific color, to decrease the plurality of modified gray scale values of the sub-pixels and the gray scale values of the sub-pixels of the colors other than the specific color in the non-white-tending and non-color-lacking sub frame. It is worth mentioning, the eighth look-up table or the eighth equation used by the gray scale values of the sub-pixels of different colors may be identical as well as different, which is not a limitation to the present disclosure.

In addition, in the present embodiment, the order of steps S603-S605 and steps S606-S608 may be exchanged. In other words, the system may firstly determine whether the frame includes the non-white-tending and non-color-lacking sub frame, and process the gray scale values of the sub-pixels in the non-white-tending and non-color-lacking sub frame, then determine whether the frame includes the white-tending sub frame and process the gray scale values of the sub-pixels in the white-tending sub frame. In summary, sequences of the steps are not meant to limit the present disclosure.

Figure 7A:
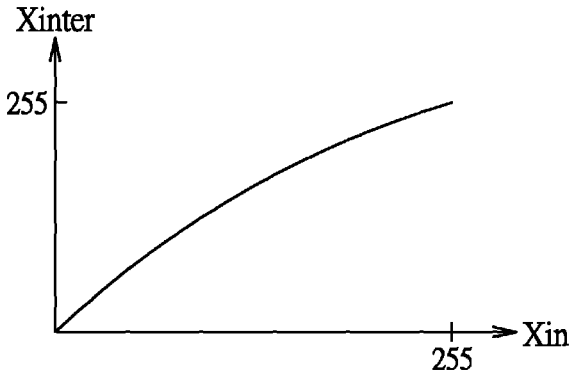
FIG. 7A shows a curve graph of gray scale values of sub-pixel of a specific color versus modified gray scale values of sub-pixels increased based on the reduced level of the colored light source of the specific color according to one embodiment of the present disclosure.
Figure 7B:
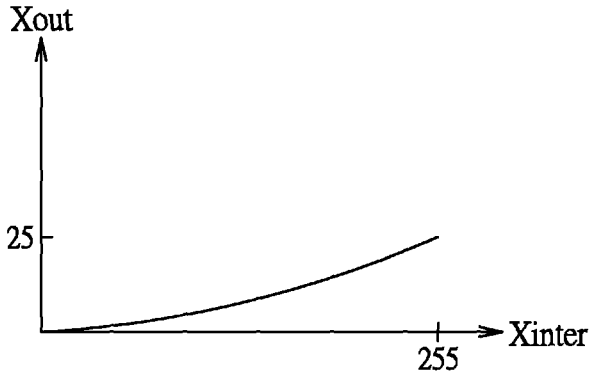
FIG. 7B shows a curve graph of modified gray scale values of sub-pixel of the specific color versus modified gray scale values of sub-pixels decreased based on the intensified level of the colored light sources of the colors other than the specific color according to one embodiment of the present disclosure.
Figure 7C:
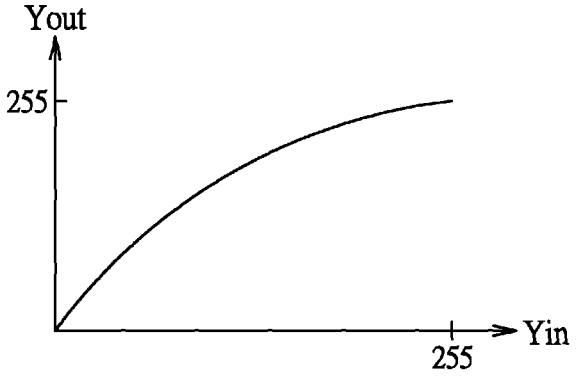
FIG. 7C shows a curve graph of gray scale values of sub-pixel of the colors other than the specific color versus modified gray scale values of sub-pixels decreased based on the intensified level of the colored light source of the colors other than the specific color according to one embodiment of the present disclosure.

Next, please refer to FIGS. 7A to 7C. FIG. 7A shows a curve diagram of the gray scale values of the sub-pixel of the specific color and the modified gray scale values of the sub-pixels increased based on the reduced level of the colored light source of the specific color according to one embodiment of the present disclosure. FIG. 7B shows a curve diagram of the modified gray scale values of the sub-pixel of the specific color and the modified gray scale values of the sub-pixels decreased based on the intensified level of the colored light sources of the colors other than the specific color according to one embodiment of the present disclosure. FIG. 7C shows a curve diagram of the gray scale values of the sub-pixel of the colors other than the specific color and the modified gray scale values of the sub-pixels decreased based on the intensified level of the colored light source of the colors other than the specific color according to one embodiment of the present disclosure.

For example, when the multiple colored light sources include red, green, and blue light sources, and the red light source in the frame is intensified 10 times while the green and the blue light sources are reduced 5 times, the range of gray scale values of the sub-pixels of the specific color in the non-white-tending and non-color-lacking sub frame would stay unchanged as 0-255 after the gray scale values are increased based on the level that the colored light source of the specific color is reduced, as shown in FIG. 7A.

As FIG. 7B shows, when the modified gray scale values of the sub-pixels of the specific color in the white-tending sub frame is decreased based on the intensified level of the colored light sources of the colors other than the specific color, the range of the modified gray scale values of the sub-pixels of the specific color in the white-tending sub frame would become 0-25 from 0-255. As FIG. 7C shows, when the gray scale values of the sub-pixels of the colors other than the specific color in the non-white-tending and non-color-lacking sub frame are decreased based on the level that the colored light sources of the colors other than the specific color are intensified, the range of the gray scale values of the sub-pixels of the colors other than the specific color in the non-white-tending and non-color-lacking sub frame would not change and maintain as 0-255.

Please note that when the modified gray scale values of the sub-pixels in the white-tending sub frame are decreased based on the level that the colored light sources of the colors other than the specific color are intensified, the modified gray scale values are not equal to the original gray scale values of the sub-pixel of the specific color in the white-tending sub frame, neither the modification level of the gray scale values of the sub-pixels is inversely proportional to the adjustment level of colored light sources.

[Possible Effects of the Embodiments]

According to the embodiments of the present disclosure, the display apparatus and the display control method could reduce power consumption caused by the multiple colored light sources of the display apparatus. Furthermore, it does not require greater complexity to implement the display apparatus and the display control method, and thus the device and the method are suitable for mass producing related products and are highly practical.

Moreover, since the display control method may effectively compensate the gray scale values of the sub-pixels of white-tending sub frames, non-white-tending and non-color cast sub frames, or non-white-tending and non-color-lacking sub frames, and therefore color cast or color lacking in white-tending sub frames, non-white-tending and non-color cast sub frames, and non-white-tending and non-color-lacking sub frames could be prevented.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A display control method, adapted to a display apparatus having a plurality of colored light sources used to emit a plurality of different colored lights, in which a frame of the display apparatus includes at least a color cast sub frame and at least a white-tending sub frame, wherein the color cast sub frame tends to at least a specific color that is able to be divided into at least one of the colored light of the one or more different colors, the method comprising:

for the frame, intensifying the colored light source of the specific color and reducing the colored light sources of colors other than the specific color;

for the white-tending sub frame, decreasing a plurality of gray scale values corresponding to the specific color in the white-tending sub frame based on a level that the colored light source of the specific color is intensified, to generate a plurality of modified gray scale values; and for the white-tending sub frame, increasing the plurality of modified gray scale values and a plurality of gray scale values corresponding to the colors other than the specific color based on a level that the colored light sources of the colors other than the specific color are reduced.

2. The display control method according to claim 1, wherein on, off, adjustment, intensity, and brightness of the colored light sources is dynamically adjusted based on the color cast.

3. The display control method according to claim 1, wherein after processing the plurality of gray scale values of the white-tending sub frame, the white-tending sub frame tends to white or pale white.

4. The display control method according to claim 1, wherein color temperature of the white-tending sub frame is between 4000K and 12000K.

5. The display control method according to claim 1, wherein the frame further includes at least a non-white-tending and non-color cast sub frame and the method further comprises:

for the non-white-tending and non-color cast sub frame, decreasing a plurality of gray scale values corresponding to the specific color in the non-white-tending and non-color cast sub frame based on a level that the colored light source of the specific color is intensified, to generate a plurality of modified gray scale values; and for the non-white-tending and non-color cast sub frame, increasing a plurality of gray scale values corresponding to the colors other than the specific color based on a level that the colored light sources of the colors other than the specific color are reduced.

6. The display control method according to claim 1, wherein for the white-tending sub frame, based on the level that the colored light source of the specific color is intensified and the gray scale values of the specific color, a first look-up table or a first equation is referred to decrease the plurality of gray scale values of the specific color in the white-tending sub frame, in order to generate the plurality of modified gray scale values of the sub-pixels, or based on the level that the colored light sources of the colors other than the specific color are reduced, the plurality of modified gray scale values, and the gray scale values of the colors other than the specific color, at least a second look-up table or at least a second equation is referred to increase the plurality of modified gray scale values of the specific color and a plurality of gray scale values of the colors other than the specific color in the white-tending sub frame.

7. The display control method according to claim 6, wherein for the non-white-tending and non-color cast sub frame, based on the level that the colored light source of the specific color is intensified and the gray scale values of the specific color, a third look-up table or a third equation is referred to decrease the plurality of gray scale values of the specific color in the non-white-tending and non-color cast sub frame, in order to generate the plurality of modified gray scale values of the sub-pixels, or based on the level that the colored light sources of the colors other than the specific color are reduced and the gray scale values of the colors other than the specific color, at least a fourth look-up table or at least a fourth equation is referred to increase a plurality of gray scale values of the colors other than the specific color in the non-white-tending and non-color cast sub frame.

8. The display control method according to claim 1, wherein the frame is divided into a plurality of physical independent sub frames which corresponds to a portion of the colored light sources, wherein the color cast sub frame is composed of a portion of the plurality of physical independent sub frames, and the white-tending sub frame is composed of the rest of the plurality of physical independent sub frames.

9. The display control method according to claim 1, wherein the colored light emitted from the plurality of colored light sources provides various different adjustable intensities by dividing into a plurality of sectional frame and/or a plurality of time sequences.

10. The display control method according to claim 1, wherein an intergrade zone is prepared between a boundary of the white-tending sub frame and the color cast sub frame for gradually changing Chroma and the gray scale values of the sub-pixels between the white-tending sub frame and the color cast sub frame in a tiered manner, or/and an intergrade zone is prepared between a boundary of the white-tending sub frame and the non-color cast sub frame for gradually changing Chroma and the gray scale values of the sub-pixels between the white-tending sub frame and the non-color cast sub frame in a tiered manner.

11. A display control method, adopted to a display apparatus having a plurality of colored light sources used to emit a plurality of color light of different colors, in which a frame of the display apparatus includes at least a color-lacking sub frame and at least a white-tending sub frame, wherein the color-lacking sub frame lacks in at least a specific color that is able to be divided into at least one of the colored light of the one or more different colors, the method comprising:

for the frame, reducing the colored light source of the specific color and intensifying the colored light sources of colors other than the specific color;

for the white-tending sub frame, increasing a plurality of gray scale values corresponding to the specific color in the white-tending sub frame based on a level that the colored light source of the specific color is reduced, to generate a plurality of modified gray scale values; and for the white-tending sub frame, decreasing the plurality of modified gray scale values and a plurality of gray scale values corresponding to the colors other than the specific color based on a level that the colored light sources of the colors other than the specific color are intensified.

12. The display control method according to claim 11, wherein on, off, adjustment, intensity, and brightness of the colored light sources is dynamically adjusted based on the color lacking.

13. The display control method according to claim 11, wherein after processing the plurality of gray scale values of the white-tending sub frame, the white-tending sub frame tends to white or pale white.

14. The display control method according to claim 11, wherein color temperature of the white-tending sub frame is between 4000K and 12000K.

15. The display control method according to claim 11, wherein the frame further includes at least a non-white-tending and non-color-lacking sub frame and the method further comprises:

for the non-white-tending and non-color-lacking sub frame, increasing a plurality of gray scale values corresponding to the specific color in the non-white-tending and non-color-lacking sub frame based on a level that the colored light source of the specific color is reduced, to generate a plurality of modified gray scale values; and for the non-white-tending and non-color-lacking sub frame, decreasing a plurality of gray scale values corresponding to the colors other than the specific color in the non-white-tending and non-color-lacking sub frame based on a level that the colored light sources of the colors other than the specific color are intensified.

16. The display control method according to claim 11, wherein for the white-tending sub frame, based on the level that the colored light source of the specific color is reduced and the gray scale values of the specific color, a fifth look-up table or a fifth equation is referred to increase the plurality of gray scale values of the specific color in the white-tending sub frame, in order to generate the plurality of modified gray scale values of the sub-pixels, or based on the level that the colored light sources of the colors other than the specific color are intensified, the plurality of modified gray scale values, and the gray scale values of the colors other than the specific color, at least a sixth look-up table or at least a sixth equation is referred to decrease the plurality of modified gray scale values of the specific color and a plurality of gray scale values of the colors other than the specific color in the white-tending sub frame.

17. The display control method according to claim 16, wherein for the non-white-tending and non-color-lacking sub frame, based on the level that the colored light source of the specific color is reduced and the gray scale values of the specific color, a seventh look-up table or a seventh equation is referred to increase the plurality of gray scale values of the specific color in the non-white-tending and non-color-lacking sub frame, in order to generate the plurality of modified gray scale values of the sub-pixels, or based on the level that the colored light sources of the colors other than the specific color are intensified and the gray scale values of the colors other than the specific color, at least an eighth look-up table or at least an eighth equation is referred to decrease a plurality of gray scale values of the colors other than the specific color in the non-white-tending and non-color-lacking sub frame.

18. The display control method according to claim 11, wherein the frame is divided into a plurality of physical independent sub frames which correspond to a portion of the colored light sources, wherein the color-lacking sub frame is composed of a portion of the multiple physical independent sub frames, and the white-tending sub frame is composed of the rest of the multiple physical independent sub frames.

19. The display control method according to claim 11, wherein the color light emitted from the multiple colored light sources provide various different adjustable intensities by dividing into a plurality of sectional frames and/or a plurality of time sequences.

20. The display control method according to claim 11, wherein an intergrade zone is prepared between a boundary of the white-tending sub frame and the color-lacking sub frame for gradually changing Chroma and the gray scale values of the sub-pixels between the white-tending sub frame and the color-lacking sub frame in a tiered manner, or/and an intergrade zone is prepared between a boundary of the white-tending sub frame and the non-white-tending and non-color-lacking sub frame for gradually changing Chroma and the gray scale values of the sub-pixels between the white-tending sub frame and the non-white-tending and non-color-lacking sub frame in a tiered manner.

* * * * *